US011970308B2

(12) United States Patent
Meggitt et al.

(10) Patent No.: US 11,970,308 B2
(45) Date of Patent: Apr. 30, 2024

(54) CONTAINER FACILITATING MEASURING DIMENSIONS

(71) Applicant: Coolside Limited, Glasgow (GB)

(72) Inventors: Ryder Magnus Iain Meggitt, Hillend Dunfermline (GB); Eilidh Alexandra Earle-Mitchell, Glasgow (GB); Jonathan Ian Campbell, Glasgow (GB)

(73) Assignee: Coolside Limited, Glasgow (GB)

( * ) Notice: Subject to any disclaimer, the term of this patent is extended or adjusted under 35 U.S.C. 154(b) by 0 days.

(21) Appl. No.: 17/623,864

(22) PCT Filed: Jul. 8, 2020

(86) PCT No.: PCT/GB2020/051647
§ 371 (c)(1),
(2) Date: Dec. 29, 2021

(87) PCT Pub. No.: WO2021/005369
PCT Pub. Date: Jan. 14, 2021

(65) Prior Publication Data

US 2022/0363440 A1 Nov. 17, 2022

(30) Foreign Application Priority Data

Jul. 8, 2019 (GB) ..... 1909752

(51) Int. Cl.
*B65D 25/20* (2006.01)
*B65D 5/42* (2006.01)

(52) U.S. Cl.
CPC ..... *B65D 25/205* (2013.01); *B65D 5/4233* (2013.01); *B65D 2203/12* (2013.01)

(58) Field of Classification Search
CPC ..... B65D 5/42; B65D 5/4233; B65D 23/14; B65D 25/20; B65D 25/205; B65D 2203/12
(Continued)

(56) References Cited

U.S. PATENT DOCUMENTS

2008/0171153 A1 7/2008 Weston et al.
2019/0200704 A1 7/2019 Drey et al.

FOREIGN PATENT DOCUMENTS

CN 201 512 211 6/2010
GB 797478 7/1958
(Continued)

*Primary Examiner* — Bryon P Gehman
(74) *Attorney, Agent, or Firm* — Dorton & Willis LLP; Ryan Willis

(57) ABSTRACT

A container (10) and a method facilitating measuring a member, for example measuring the length or perimeter of a user's lower leg e.g. the calf and/or ankle. The method comprises aligning and locating a first datum (24) of the container (10) against a second datum on the member followed by rolling the container's perimeter relative to a section of the member to be measured. Measurement is complete when the container (10) has rolled from the first datum (24) along the minor surfaces until a point of the container (10) reaches an extremity of the member/dimension being measured; the extremity may be the second datum, where a circumference of a member is being measured. When rolling the perimeter of the container (10) is complete a point of the container face (12) will be aligned with a point representing the extremity of the dimension being measured or the second datum. Alignment of two points at the extremity of the measured member is indicative of the dimension of the member. Thereby, the dimension, for example the perimeter, of the member can be determined by reading off markings provided on one or more exterior minor
(Continued)

faces of the container or by physically measuring the container perimeter.

23 Claims, 5 Drawing Sheets

(58) Field of Classification Search
USPC ..... 206/459.5
See application file for complete search history.

(56) References Cited

FOREIGN PATENT DOCUMENTS

| | | |
|---|---|---|
| GB | 1909752.6 | 1/2020 |
| WO | 2021/005369 | 1/2021 |

CONTAINER FACILITATING MEASURING DIMENSIONS

This application is a national stage of PCT/GB2020/051647, filed Jul. 8, 2020, which claimed priority to Great Britain patent application number 1919752.6, filed Jul. 8, 2019, all of which are incorporated by reference.

FIELD OF THE INVENTION

The present invention relates to a container and a method of using a container to measure a dimension of an object, for example the perimeter or length of an object. More particularly, the invention relates to a container configured to be rotated relative to the object to be measured. By way of example only, the container may contain compression socks, wherein the container incorporates a shape and markings, which facilitate measuring the circumference of a user's upper calf and lower calf (ankle area) such that the appropriate size of compression sock can be selected.

BACKGROUND TO THE INVENTION

Compression socks are specialised hosiery, which are designed to help prevent venous disorders such as phlebitis and thrombosis. Compression socks typically have the appearance of knee-high socks but are designed to compress the lower leg upon which they are worn.

To ensure adequate compression, the socks typically include elastic properties, e.g. provided by LYCRA®, which is incorporated into the knit of the socks. This means, when the socks are worn the lower leg upon which they are worn is compressed. Compression of the lower leg can help reduce the diameter of distended veins and can help increase the velocity of venous blood flow.

Compared with day-to-day socks and athletic socks, compression socks use stronger elastics to ensure the desired compression on the feet, ankles and lower leg. Typically, compression socks use graduated compression i.e. the socks are more compressive in the region of the lower calf and ankles; typically, compression affect gradually reduces toward the knee.

Compression socks are typically worn by passengers on long haul flights. Wearing compression socks when travelling can provide effective compression therapy, which helps relieve heavy and aching legs.

It will be appreciated that one size of compression sock does not fit all. For example, a compression sock considered large would be unlikely to provide the desired compression effect if worn by a "small" person. Similarly, a small compression sock would likely result in too much compression of a larger person's limb and an uncomfortable wear or potentially harmful wear.

Knee-high compression socks are used to help increase circulation and to help prevent the formation of blood clots in the lower legs.

SUMMARY OF THE INVENTION

The present invention provides a container comprising:

a hollow body having an interior configured to contain one or more objects and an exterior configured and operable to perform a measurement of a dimension of one or more members, wherein the dimension of the one or more members is associated with size of the one or more objects to be contained in the container;

wherein the hollow body is defined by two major surfaces spaced by at least one minor surface, wherein a point or edge on the minor surface defines a first datum, which, in use, is located against or adjacent to a corresponding second datum on one of the one or more members; and wherein the at least one minor surface includes exterior markings, wherein the markings are indicative of a measured dimension;

wherein the minor surface defines a perimeter of the container and a rolling surface, which facilitates measuring a dimension of the one or more members wherein rotating the container along the rolling surface from the first datum point or edge relative to the member to be measured provides a measurement of the member, wherein rolling the container is completed when a point on the minor surface aligns with an extremity of the dimension being measured, thereby defining the rolled distance;

wherein markings at the point of alignment of the point on the minor surface and the extremity of the member represent a measured dimension of the member, which measured dimension facilitates selection of an appropriate size object.

The one or more members may comprise one or more locations on the same member, for example a first location may be the widest part of a user's lower leg i.e. calf muscle area; this first location corresponds with one member. The second location may be the narrowest part of a user's lower leg i.e. ankle or area below the calf muscle; this second location corresponds with another member.

The body may include at least two opposing major surfaces spaced by at least two relatively minor surfaces and corresponding edges between the minor surfaces, wherein an edge between the minor surfaces provides the first datum and the minor surfaces define the rolling surface to facilitate measurement of the member.

The first datum may be defined by an edge defined between two minor surfaces.

The container may further comprise an extension member extending from one end of one major surface and extending relative to the minor surface which is adjacent to the major surface, wherein the minor surface also extends from the first datum. The extension member facilitates correct rolling direction of the body to ensure accurate perimeter dimension measurement of the one or more members or one or more locations of the same member.

The minor surface or surfaces may include two areas of exterior markings associated with two ranges of dimensions, wherein a first marked area represents measurement of a first dimension and a second marked area represents measurement of a second dimension, wherein a minimum of the first dimension as represented by the first area is larger than a maximum of the second dimension as represented by the second area.

For example, the body may include four minor surfaces, wherein two of the four minor surfaces include exterior markings associated with a range of perimeter dimensions, wherein one marked minor surface represents measurement of a first dimension and the other marked minor surface represents measurement of a second dimension, wherein a minimum of the second dimension markings is larger than a maximum of the first dimension markings; and wherein the marked minor surfaces are disposed opposite the minor surfaces defining the first datum edge.

The container may be a rectangular parallelepiped including two opposing rectangular-shaped major surfaces separated by four relatively minor surfaces and wherein the minor surfaces facilitate rolling the container about its perimeter from first datum to minor surface to minor surface relative to the member to be measured. Alternatively, the major surfaces of the container may be a hexagon, wherein each surface is separated by six relatively minor surfaces, which facilitate rolling the container from first datum to minor surface to minor surface relative to the member to be measured. Alternatively, the major surfaces of the container may be rounded, for example a circle, an oval, an ellipse, wherein the major surfaces are separated by a substantially continuous minor surface, which facilitates rolling the container from first datum along the perimeter defined by the minor surface relative to the member to be measured. Alternatively, the major surfaces of the container may be a curved rectangle comprising two straight edges and two curved edges, wherein each major surface is separated by a substantially continuous minor surface, which facilitates rolling the container about its perimeter from first datum along the minor surface relative to the member to be measured.

The exterior markings for each dimension measurement may comprise graded markings. For example, the graded markings may represent specific dimensions or a range of dimensions.

The exterior markings may comprise one or more bands, wherein each band represents a range of predetermined dimensions.

The exterior marking may comprise one or more colour-coded bands, wherein each band represents a different dimension or range of predetermined dimensions associated with the particular dimension to be or being measured. The exterior marking may include at least three bands, wherein each band represents a different dimension or range of dimensions associated with the particular dimension to be or being measured. The bands may be colour-coded, wherein each colour-coded band represents a different dimension or range of dimensions. A container comprising three colour-coded bands may represent three different ranges of dimensions, for example sizes, small, medium and large. Additional dimension markers or bands may be included to indicate a wider range of dimensions, for example extra small, small, medium, large, extra-large, etc.

The container may comprise at least two areas of exterior markings, wherein each area of markings represents a different dimension of the same member, wherein the member includes one or more locations for circumferential dimension measurement and for comparison of the two measured dimensions for appropriate product selection.

In one example, the container may be configured to contain compression socks and wherein a first member, or first location, to be measured is the widest part of the user's calf and a second member, or second location, to be measured is the user's lower calf/ankle region, wherein one or both measurements can be used to determine appropriate size compression socks for a user.

Small calf circumference may be in the region of 28 to 38 centimetres, medium calf circumference may be in the region of 33 to 43.5 centimetres and large calf circumference may be in the region of 35.5 to 46 centimetres; and small ankle circumference may be in the region of 19 to 21.5 centimetres, medium ankle circumference may be in the region of 21.5 to 24 centimetres and large ankle circumference may be in the region of 24 to 26.5 centimetres.

A further aspect of the present invention provides a method of measuring a dimension of a member, using a container according to any preceding claim, wherein the method comprises:

aligning and locating a first datum of the container against a second datum on the member;

rolling the container, from first datum along the container perimeter, relative to a surface of the member until a point on a minor surface of the container is located against a location indicating an extremity of the dimension of the member being measured; wherein aligning the location indicating the extremity of the dimension being measured with a point on a minor surface of the container represents rolling the container along the extent of the required dimension of the first location on the member; and determining the required dimension of the member from markings on the container body where the point on the minor surface aligns with the extremity of the measured dimension.

The method of measuring a dimension of a member, using a container according to the first aspect, may further comprise: measuring and comparing two circumference dimensions to determine an appropriate size of object to fit a user, wherein the larger of the two dimensions determines the size of object required; wherein a first circumference dimension is obtained at a first location and a second circumference dimension is measured at a second location on the member, wherein the first circumference dimension is obtained by: locating the first datum of the container against a second datum on a first location of the member;

rolling the container perimeter, from first datum along the container perimeter, around the perimeter of the first location, rolling from the first datum until a point on a minor surface of the container is located against the second datum; wherein aligning the second datum with a point on the minor surface of the container represents rolling the container along the extent of the perimeter dimension of the first location;

determining the perimeter dimension of the member at the first location; and locating the first datum of the container against a second datum at a second location of the member;

rolling the container perimeter, from first datum along the container perimeter, around the perimeter of the second location, rolling from the first datum until a point on a minor surface of the container is located against the second datum; wherein aligning the second datum at the second location with a point on the minor surface of the container represents rolling the container along the extent of the perimeter dimension of the second location;

determining the second perimeter dimension of the member at the second location comparing the first perimeter dimension of the first location measurement and the second perimeter dimension of the second location measurement; and selecting a product size based on the larger of the first and second circumference.

The step of determining first and second perimeter dimensions of the first and second location on the member, may include reading dimensions from the container, wherein the container includes markings along at least one minor face, wherein the markings represent a dimension such that when the container has rolled about the extent of the member the perimeter of the member is determined from the markings in the region where a point on the container minor surface is coincident with the second datum on the member.

The container may include markings along at least one minor surface, wherein the markings represent a predetermined range of dimensions such that when the container has rolled about the extent of the member the desired dimension of the member is determined from the markings in the region where the point of the container face is coincident with the second datum on the member (where a circumference is being measured) or a point indicating the extremity of the dimension being measured.

Determining first and second perimeter dimension of the first and second location on the member, for example a user's lower leg, may include reading a dimension from the container, wherein the container includes markings along at least one minor surface, wherein the markings represent a predetermined range of perimeter dimensions such that when the container perimeter has rolled against the extent of the member the perimeter of the member is determined from the markings in the region where a point on the container face is coincident with the second datum.

It will be appreciated from the above that the container rotates relative to a surface or member to be measured. The measurement could be a linear dimension, for example, length, height, depth, breadth of an object or a circumferential dimension where the container rotates around an object to determine the circumference.

BRIEF DESCRIPTION OF THE DRAWINGS

Examples of the invention will now be described, by way of example, with reference to the drawings, in which.

DESCRIPTION

Figure 1:
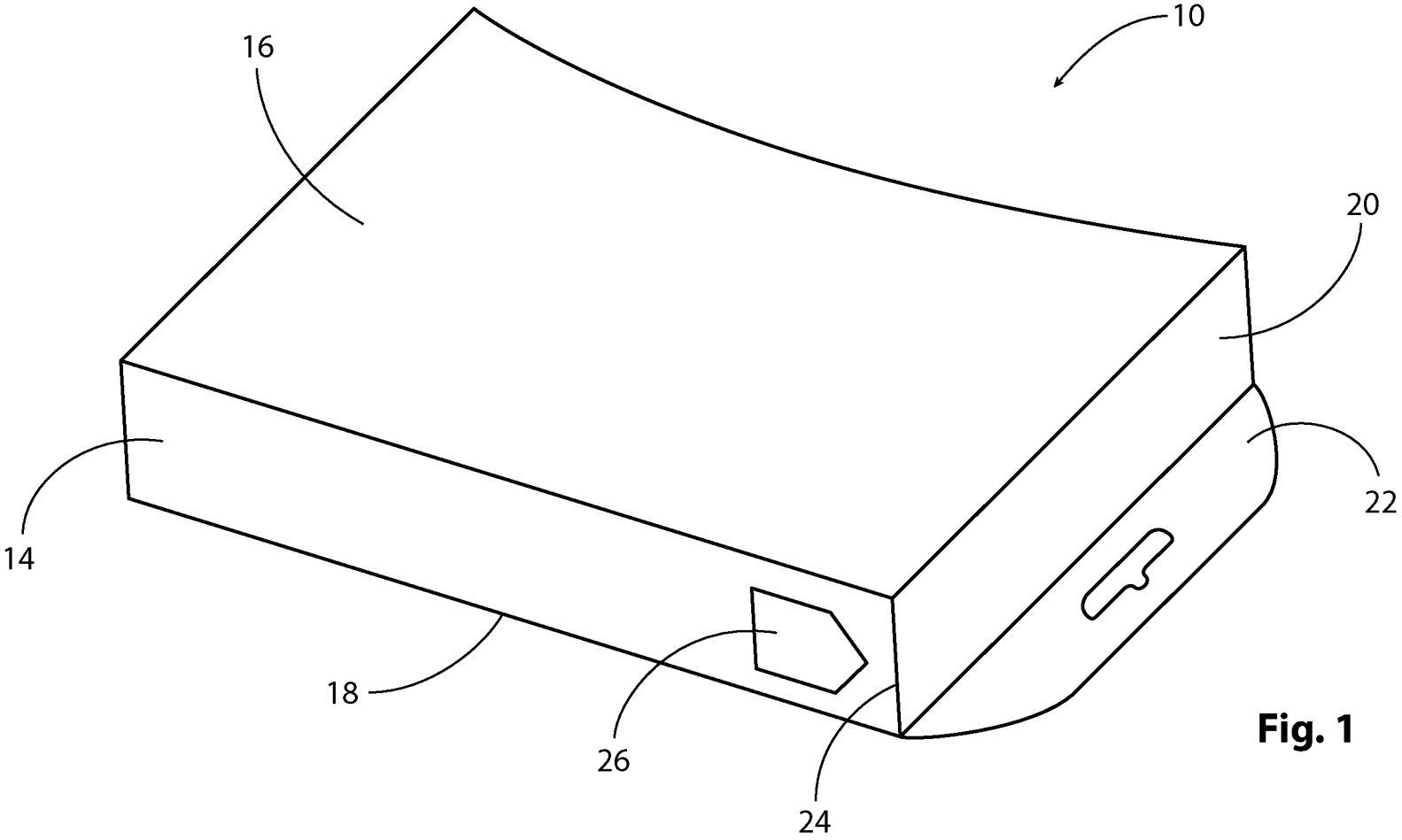
FIG. 1 illustrates a perspective view of a container for graduated compression socks, where the view is oriented to show a first datum.
Figure 2:
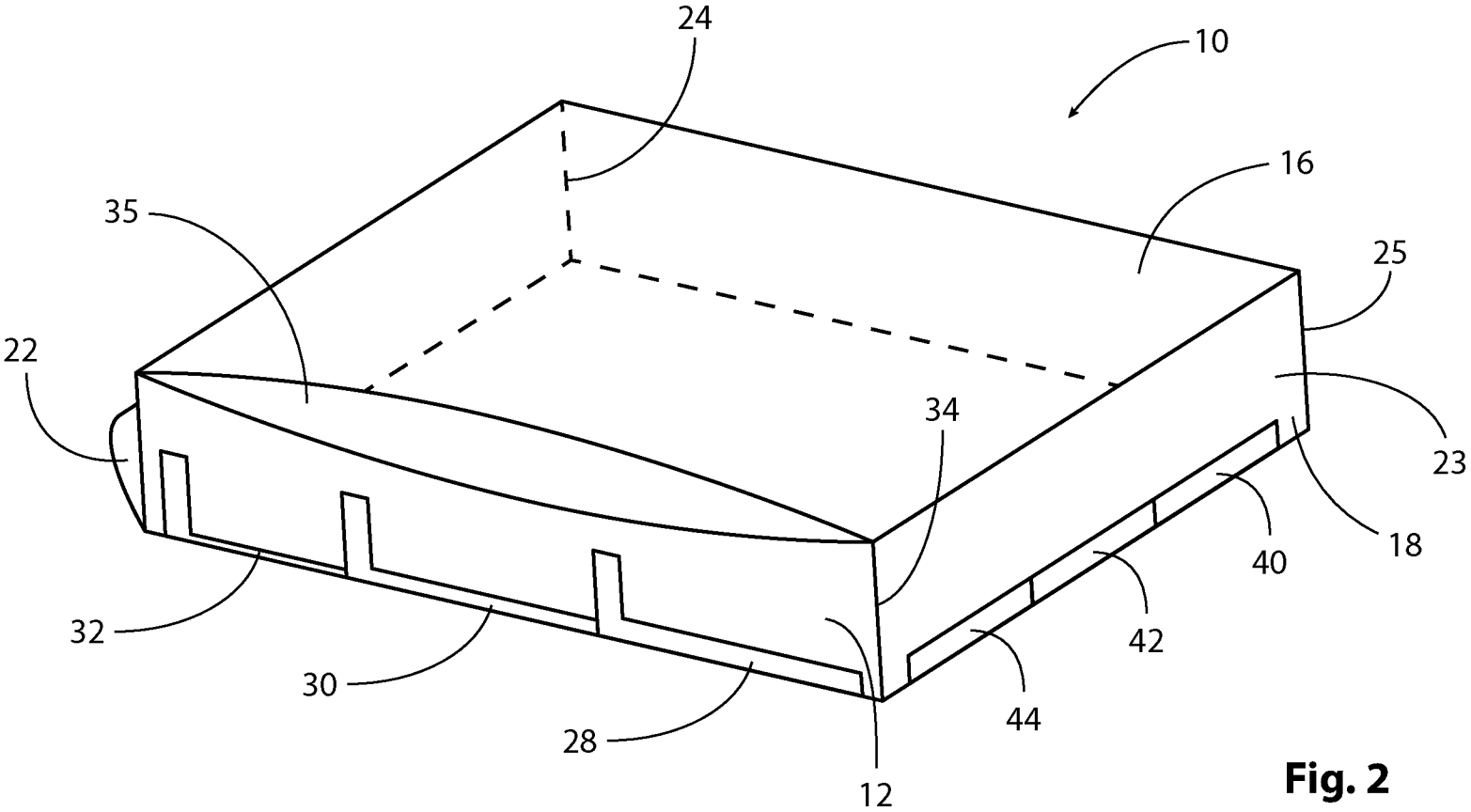
FIG. 2 illustrates a perspective view of the container of FIG. 1 reoriented to show size indicators, which representing circumference dimension of a user's leg in the region of the calf muscle and the ankle.

FIGS. 1 and 2 illustrate a retail container 10 for graduated compression socks (not illustrated).

In the illustrated example, the container 10 is substantially rectangular parallelepiped, where the container 10 includes two major rectangular surfaces, i.e. a front face 16 and a rear face 18 and four minor surfaces, which are provided by two long side faces 12, 14, a top face 20 and bottom face 23. The minor surfaces space the front face 16 from the rear face 18 to define a hollow inside, which is configured to contain a product, for example graduated compression socks. In the illustrated example, the container 10 also includes a retail hanging tab 22, which extends from the rear face 18 and the top face 20. The retail hanging tab 22, as the name suggests facilitates display, by hanging, of the product contained in the container 10. The retail hanging tab, also facilitates correct orientation of the container 10 relative to a member to be measured; this is discussed further below with regard to measuring a circumference of a user's ankle and calf to determine an appropriate size of compression sock, which is contained within the container 10

Referring to the illustrated example, an edge 24 is defined by the junction of the foremost long side face 14 and the top face 20.

With regard to the illustrated container 10, the foremost long side face 14 includes an indicator 26, which points towards edge 24 and indicates that the edge 24 is to be placed against a datum (indicated in FIGS. 3*a* and 4*a*) of the object/member to be measured, for example, a point mid-front of a user's leg (calf area or ankle area). Locating the container at the front of the calf or ankle provides the starting point from where the container 10 can rotate relative to calf or ankle to facilitate measuring the circumference of the calf area or ankle area as described further below with reference to FIGS. 3*a*, 3*b*, 4*a* and 4*b*.

FIG. 2 illustrates the container 10 rotated through 180 degrees relative to the orientation illustrated in FIG. 1. In FIG. 2 the foremost long side face 12 includes an illustration of three L-shaped bars 28, 30, 32, where the first L-shaped bar 28 extends from the edge 34 defined by the junction of the bottom face 23 and the long side face 12. The second L-shaped bar 30 extends from within the first L-shaped bar 28 and the third L-shaped bar 32 extends from within the second L-shaped bar 30. In an example the L-shaped bars 28, 30, 32 are colour-coded, where each L-shaped bar and colour thereof represent a range of dimensions, which fall within categories small, medium and large; the method of measuring and determining/recognising the measured dimension is described further below with reference to FIGS. 3*a*, 3*b*, 4*a* and 4*b*.

In the illustrated example, and relevant to the appropriate size of compression socks, the first L-shaped bar 28 represents a calf circumference in the region of 28 to 38 cm. The second L-shaped bar 30 represents a calf circumference in the region of 33 to 43.5 centimetres. The third L-shaped bar 32 represents a calf circumference of 35.5 to 46 centimetres.

The L-shaped bars 28, 30, 32 are each located on the same minor surface i.e. long side face 12, which is opposite the long side face 14, which includes the indicator 26 for the measurement starting point/first datum 24.

In the illustrated example, referring further to FIG. 2, an arcuate chamfer 35 provides the edge 35 defined between the long side face 12 and the front face 16.

In the illustrated example, the bottom face 23 also includes three markings 40, 42, 44, where each marking 40, 42, 44 is represented by a different coloured box and where each box represents a range of dimensions, which fall within categories small, medium and large.

In the illustrated example, and relevant to the appropriate size of compression socks, the first box 40 represents a small ankle circumference in the region of 19 to 21.5 cm. The second box 42 represents a medium ankle circumference in the region of 21.5 to 24 centimetres. The third box 44 represents a large ankle circumference in the region of 24 to 26.5 centimetres.

Figure 3A:
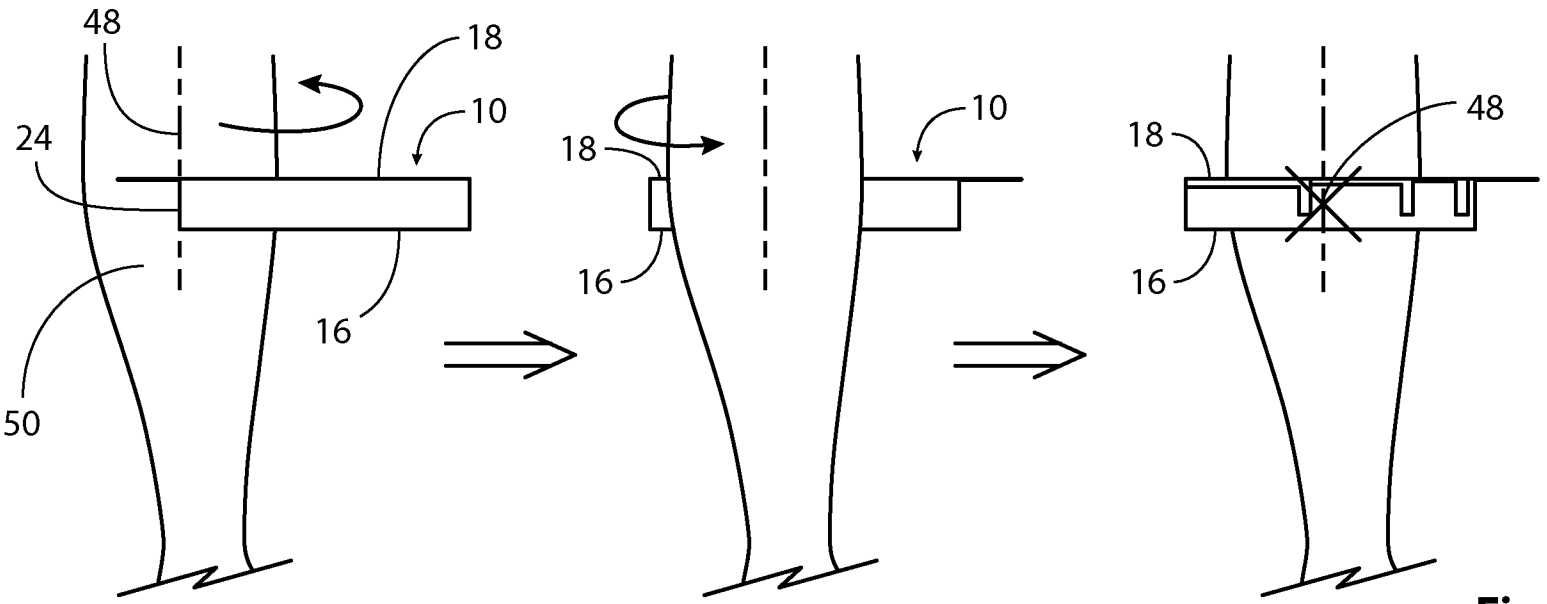
FIG. 3*a* represents the process of measuring the circumference of a user's leg in the area of the calf muscle.
Figure 3B:
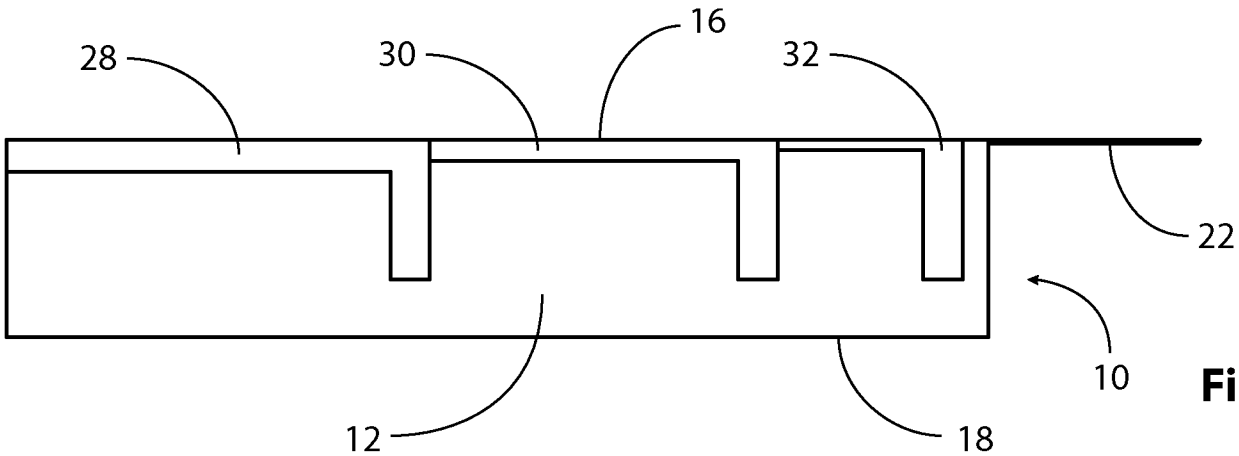
FIG. 3*b* illustrates a side view of the container of FIG. 2 showing a visual identifier of the sock size associated with a user's leg in the area of the calf muscle.

Referring to FIGS. 3*a* and 3*b*, the method of utilising the container 10 to measure a user's calf dimension is illustrated.

Stage 1 of the measuring process is locating the edge 24 of the container to the front and centre 48 of the user's shin 50; as noted above the long side face 14 includes an indicator 26 to ensure the correct edge 24 is placed against the user's shin 50.

To ensure the correct measurement is taken, initial placement of the container 10 against the shin 50 should be substantially central and should correspond with the widest part of the calf.

The next stage of the measuring process is to roll the container 10 around the leg, transferring from edge 24 to face 14 to edge 25 to face 23 etc. until a minor surface, i.e. the long side face 12, of the container 10, is located against the front of the shin 50. The container 10 is sized such that the calf circumference dimension is determined from the L-shaped bars 28, 30, 32 on the long side face 12. The appropriate size of compression sock is determined by aligning the centre 48 of the shin 50 within the band defined by the L-shaped bars 28, 30, 32 on the long side face 12. The L-shaped bar 28, 30, 32 in which the centre-point 48 of the shin 50 falls indicates the user's size i.e. small, medium or large. As noted above small represents a calf circumference in the region of 28 to 38 cm, medium represents a calf circumference in the region of 33 to 43.5 centimetres and large represents a calf circumference of 35.5 to 46 centimetres.

Similar to the process illustrated in FIGS. 3*a* and 3*b*, FIGS. 4*a* and 4*b* illustrate the method of utilising the container 10 to measure a user's ankle dimension, more specifically the narrower part of the leg beneath the calf muscle.

Stage 1 of the measuring process is initial placement of the container 10 against the front of the ankle area 51 such that the edge 24 is located against the front of the leg in a position substantially front and centre 48 of the ankle area 51 i.e. the narrow area below the bottom of the calf muscle and above the ankle; The indicator 26 on the long side face 14 indicates which edge, i.e. edge 24, should be located against the user's leg.

The next stage of the measuring process is to roll the container around the leg, transferring from edge 24 to face 14 to edge 25 to face 23 etc. until face 23 of the container 10 is located against the front of the leg/ankle area 51. To determine the size of compression sock required of the ankle area 51 is located. The bar 40, 42, 44 in which the centre-point lies, following full extent rolling of the container 10 relative to the user's leg, indicates the user's size i.e. small, medium or large. As noted above, a small ankle circumference is in the region of 19 to 21.5 cm, a medium ankle circumference is in the region of 21.5 to 24 centimetres and a large ankle circumference is in the region of 24 to 26.5 centimetres.

The container 10 is sized such that the narrower ankle dimension is identified within the bars/range of dimensions 40, 42, 44 represented on the bottom face 23 and such that the wider calf dimension is identified within the bars/range of dimensions represented by the L-shaped bars 28, 30, 32 provided on the long side face 14.

Figure 4A:
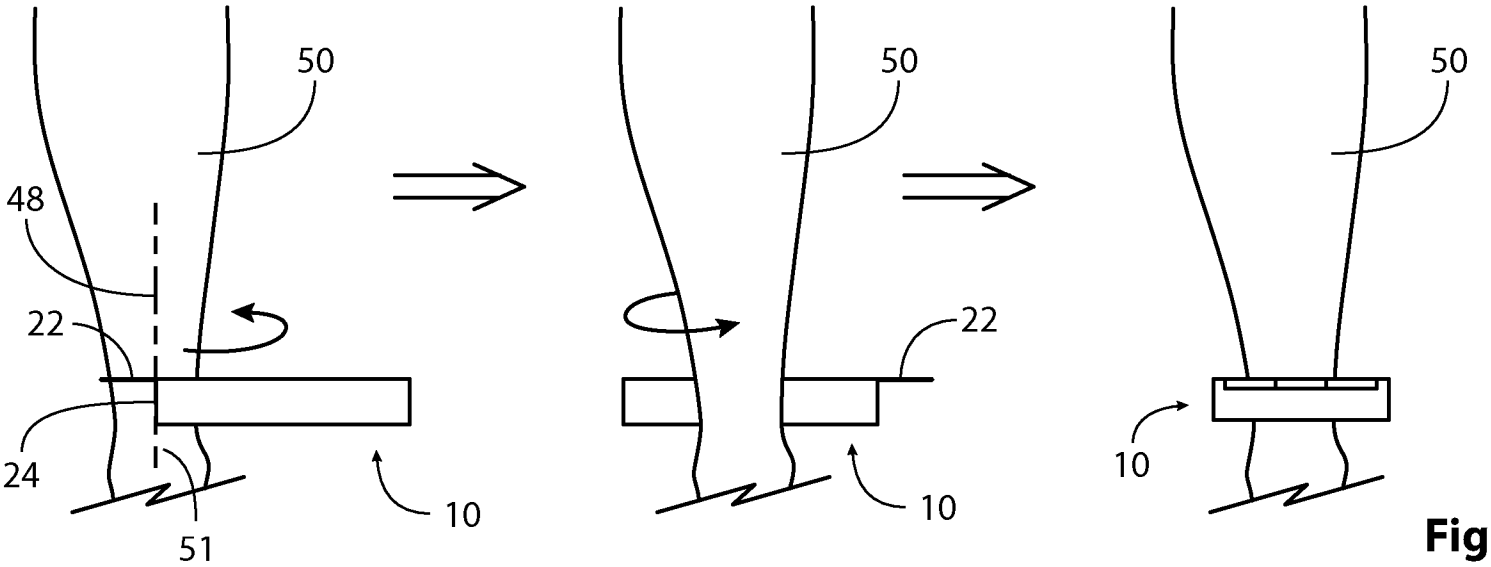
FIG. 4*a* represents the process of measuring the circumference of a user's leg in the area of the ankle.
Figure 4B:
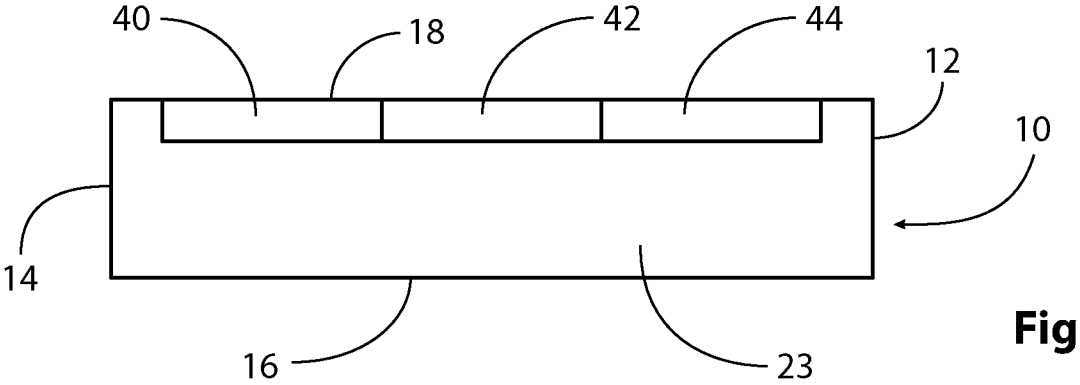
FIG. 4*b* illustrates an end view of the container of FIG. 2 showing a visual identifier of the sock size associated with a user's leg in the area of the ankle.

The datum edge 24 being located adjacent the hanging tab 22 assists the user with proper placement of the container 10 relative to the calf or ankle and ensures that the user rolls the container 10 in the correct direction to determine the appropriate circumference dimension of the calf and ankle such that the correct/optimised size of sock can be selected. As can be seen in FIGS. 3*a* and 4*a* the retail tab is arranged as the top surface and pointing across the leg; this means rotation of the container relative to the leg is clockwise.

As noted in the background to the invention, compression socks typically subject the lower leg to graduated compression i.e. greatest compression in the ankle region with reducing compression effect towards the top of the compression sock e.g. just below the knee. One or both circumference measurements could be utilised to choose the appropriate compression sock, but in view of the graduated compression the ankle measurement is dominant to ensure appropriate compression for the user. As such, it is recommended that both calf and ankle circumferences are measured and if the zone, small, medium, or large is different from both measurements the larger of the two measurements should indicate the level of compression required i.e. by the size indicated by bars 28, 30, 32, 40, 42, 44. Accordingly, if a consumer measures both regions of the lower leg they can decide which size of sock they should choose if the dimension indicated for their ankle is a different dimension indicated for their calf. For example, if the dimension indicator for the ankle is medium, but the dimension indicator for the calf is large, the customer should select compression socks, size large.

Figure 5C:
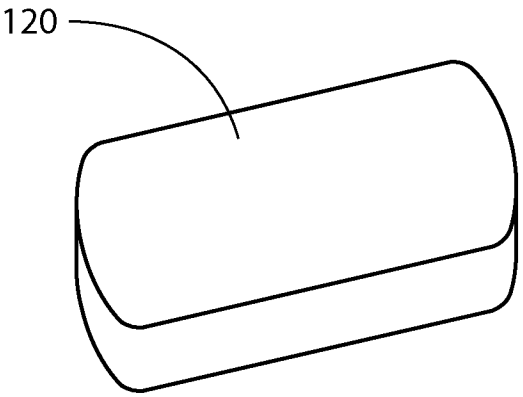
FIGS. 5*a*, 5*b* and 5*c* illustrate examples of alternative shaped containers compared with those illustrated in FIGS. 1 and 2.
Figure 5B:
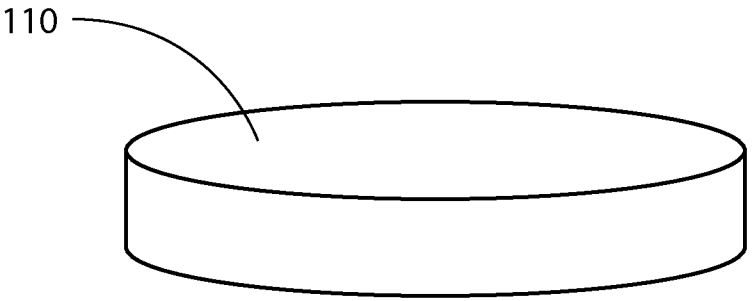
Figure 5A:
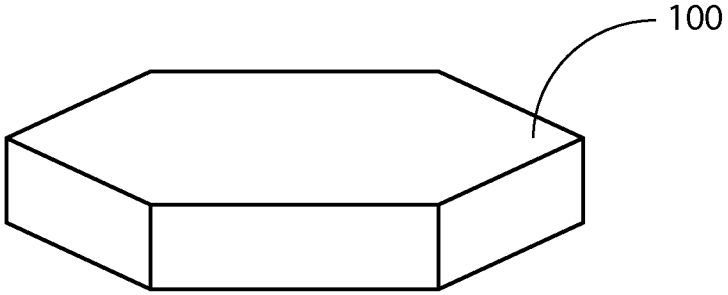

The illustrated example is described in relation to measuring the circumference of a user's leg or ankle using a rectangular shaped container. However, it should be appreciated that measuring a dimension is facilitated by rolling/rotating the container relative to a member. As such, it will be appreciated that the container 10 facilitates measuring linear dimensions (e.g. length, breadth, height, depth etc) and circumferential/part circumferential dimensions. In addition, the container 10 is described as a rectangular parallelepiped. However, it should be appreciated that other shaped containers may be adapted to measure dimensions of member/objects. The major surface of such alternative containers may take the form of a hexagon 100, a circle 110, a curved rectangle 120 etc. (see FIGS. 5*a*, 5*b*, 5*c* by way of example).

The examples described above relate to measuring the circumferential dimension of a user's leg for compression socks. However, it will be appreciated that circumferential measurements of other body parts e.g. head, neck etc. may be useful in selecting appropriately sized objects. In addition, as noted above the container described may be adapted to measuring linear dimensions e.g. from knee to foot and non-body parts.

In FIGS. 2, 3*a*, 3*b* and 4*b*, a range of dimensions is indicated by bands 28, 30, 32, 40, 42, 44. However, it should be appreciated the markings may be more graded, with multiple size indicators closer to a ruler for more precise customisation rather than limit to a precise e.g. 3 to 5 bands.

The examples illustrated in FIGS. 3*a* and 4*a* represent rolling the circumference of the container 10 relative to a user's lower leg to measure the leg's circumference. In each example the container is shown to rotate less than a full turn. However, it should be appreciated that measuring a particular dimension may require multiple full rolls of the container 10. In this instance, the cumulative number of rolls/rotations of the container 10 relative to the limb or object to reach the specific endpoint i.e. the extremity of the dimension being measured, would combine to give the total length/perimeter of the measured object.

While specific embodiments of the present invention have been described above, it will be appreciated that departures from the described embodiments may still fall within the scope of the present invention.

The invention claimed is:

1. A container comprising:

a hollow body having an interior configured to contain one or more objects and an exterior configured and operable to perform a circumferential measurement of a dimension of one or more members, wherein the dimension of the one or more members is associated with the size of the one or more objects to be contained in the container;

wherein the hollow body is defined by two major surfaces spaced by at least one minor surface, wherein a point or edge on the at least one minor surface defines a first datum, which, in use, is located against or adjacent to a corresponding second datum on one of the one or more members; and wherein the at least one minor surface includes exterior markings, wherein the markings are indicative of a measured circumferential dimension;

wherein the at least one minor surface defines a rolling surface that can be engaged with and rolled around the one or more members, which facilitates measuring a circumferential dimension of the one or more members wherein engaging the container with the one or more members and rotating the container along the rolling surface from the first datum point or edge around the one or more members to be measured provides a circumferential measurement of the one or more members, wherein a rolling action is completed when a point on the at least one minor surface aligns with the second datum, thereby defining a rolled distance, wherein markings at the point on the at least one minor surface represent a measured circumferential dimension of the one or more members, which measured dimension facilitates selection of an appropriate size object.

2. A container as claimed in claim 1, wherein the body includes at least two opposing major surfaces spaced by at least two relatively minor surfaces and corresponding edges between the minor surfaces, wherein an edge between the minor surfaces provides the first datum and the minor surfaces define the rolling surface to facilitate measurement of the one or more members.

3. A container as claimed in claim 2, wherein the first datum is defined by an edge defined between two minor surfaces.

4. A container as claimed in claim 2, wherein the at least one minor surface includes two areas of exterior markings associated with two ranges of dimensions, wherein a first marked area represents measurement of a first dimension and a second marked area represents measurement of a second dimension, wherein a minimum of the first dimension as represented by the first area is larger than a maximum of the second dimension as represented by the second area.

5. A container as claimed in claim 1, further comprising an extension member extending from one end of one major surface and extending relative to the at least one minor surface which is adjacent to the major surface, wherein the at least one minor surface adjacent to the major surface also extends from the first datum.

6. A container as claimed in claim 1, being a rectangular parallelepiped including two opposing rectangular-shaped major surfaces separated by four relatively minor surfaces and wherein the minor surfaces facilitate rolling the container from first datum to minor surface to minor surface relative to the member to be measured.

7. A container as claimed in claim 6, wherein the first and second marked areas are disposed opposite the minor surface defining the first datum.

8. A container as claimed in claim 1, wherein the major surfaces are hexagonal and wherein each surface is separated by six relatively minor surfaces, which facilitate rolling the container from first datum to minor surface to minor surface relative to the member to be measured, and wherein one or more of the minor surfaces include the exterior markings to facilitate measuring a dimension and representing one of more dimensions.

9. A container as claimed in claim 1, wherein the major surfaces of the container are rounded, wherein the major surfaces are separated by a substantially continuous minor surface, which facilitates rolling the container from first datum along the at least one minor surface relative to the one or more members to be measured, and wherein the at least one minor surface includes one or more areas of exterior markings to facilitate measuring a dimension and representing one or more dimensions.

10. A container as claimed in claim 9, wherein the major surface is one of a circle, an oval, an ellipse and a curved rectangle, including two straight edges and two curved edges, wherein each major surface is separated by a substantially continuous minor surface, which facilitates rolling the container from first datum to minor surface to minor surface relative to the one or more members to be measured.

11. A container as claimed in claim 1, wherein exterior markings for each dimension measurement comprise graded markings.

12. A container as claimed in claim 11, wherein the exterior markings comprise one or more bands, wherein each band represents a range of predetermined dimensions.

13. A container as claimed in claim 12, wherein the exterior markings comprise one or more colour-coded bands, wherein each colour-coded band represents a range of predetermined dimensions.

14. A container as claimed in claim 11, comprising at least three bands, wherein each band represents a different dimension or range of dimensions associated with the particular dimension to be or being measured.

15. A container as claimed in claim 14, wherein each colour-coded band represents a different range of dimensions, categorised as small, medium and large.

16. A container as claimed in claim 1, comprising two areas of exterior markings, wherein each area of markings represents a different dimension of the same member, wherein the same member includes one or more locations for circumferential dimension measurement and for comparison for product selection.

17. A method of measuring a dimension of a member, using a container according to any preceding claim, wherein the method comprises:

aligning and locating the first datum of the container against the second datum on the member;

rolling the container, from the first datum along a container perimeter, relative to a surface of the member until a point on a minor surface of the container is located against a location indicating an extremity of the member; wherein aligning the location indicating an extremity of the dimension being measured with a point on the at least one minor surface of the container represents rolling the container along the extent of the required dimension of a first location on the member; and determining the required dimension of the member from markings on the container body, where the point on the minor surface aligns with the extremity of the measured dimension.

18. A method as claimed in claim 17, further comprising: measuring and comparing two circumference dimensions to determine an appropriate size of object to fit a user, wherein the larger of the two dimensions determines the size of object required; wherein a first circumference dimension is obtained at a first location and a second circumference dimension is measured at a second location on the member, wherein the first circumference dimension is obtained by: locating the first datum of the container against the second datum on a first location of the member;

rolling the container perimeter, from the first datum along the container perimeter, around the perimeter of the first location, rolling from the first datum until a point on the at least one minor surface of the container is located against the second datum; wherein aligning the second datum with a point on the minor surface of the container represents rolling the container along the extent of the perimeter dimension of the first location;

determining the perimeter dimension of the member at the first location; and locating the first datum of the container against a second datum at a second location of the member;

rolling the container perimeter, from the first datum along the container perimeter, around the perimeter of the second location, rolling from the first datum until a point on the at least one minor surface of the container is located against the second datum; wherein aligning the second datum at the second location with a point on the minor surface of the container represents rolling the container along the extent of the perimeter dimension of the second location;

determining the second perimeter dimension of the member at the second location comparing the first perimeter dimension of the first location measurement and the second perimeter dimension of the second location measurement; and selecting a product size based on the larger of the first and second circumference dimensions.

19. A method as claimed in claim 18, wherein determining first and second perimeter dimensions of the first location and the second location on the member, includes reading dimensions from the container, wherein the container includes markings along at least one minor face, wherein the markings represent a dimension such that when the container has rolled about the extent of the member the perimeter of the member is determined from the markings in the region where a point on the container minor surface is coincident with the second datum on the member.

20. A container adapted for carrying out a circumferential measurement of an ankle area and of a calf area of a person, the container comprising:

a hollow body for containing one or more objects, the hollow body defined by two major surfaces spaced by at least one minor surface;

wherein the at least one minor surface defines a rolling surface;

wherein the rolling surface is configured, in use, for engaging with and rolling around the circumference of an ankle area and a calf area to obtain measurement thereof; wherein the body comprises a first datum indicating the intended start of the rolling measurement;

wherein the body comprises a first area of exterior markings indicating a measurement of the circumference of the calf area, referenced to the first datum, when the container is engaged with and rolled around the calf area;

wherein the body comprises a second area of exterior markings, separate from the first area of exterior markings and indicating a measurement of the circumference of the ankle area, referenced to the first datum, when the container is engaged with and rolled around the ankle area.

21. A container as claimed in claim 20, wherein the first area of exterior markings is spaced apart from the second area of exterior markings along the at least one minor surface.

22. A container as claimed in claim 21, wherein the body comprises two or more minor surfaces and wherein the first area of exterior markings is located on a different minor surface to the second area of exterior markings.

23. A container as claimed in claim 20, wherein the first datum is spaced apart from the first area of exterior markings along the at least one minor surface.

* * * * *